US005483862A

United States Patent [19]

Hale

[11] Patent Number: 5,483,862

[45] Date of Patent: Jan. 16, 1996

[54] APPARATUS AND METHOD FOR HOMOGENIZING PLASTIC EXPLOSIVES

[75] Inventor: Darryl F. Hale, Vicksburg, Miss.

[73] Assignee: The United States of America as represented by the Secretary of the Army, Washington, D.C.

[21] Appl. No.: 345,722

[22] Filed: Nov. 22, 1994

[51] Int. Cl.[6] ..... F42D 1/08; C06B 21/00

[52] U.S. Cl. ..... 86/21; 264/3.2; 264/3.4

[58] Field of Search ..... 86/20.12, 21; 264/3.2, 264/3.3

[56] References Cited

U.S. PATENT DOCUMENTS

| | | | |
|---|---|---|---|
| 2,874,604 | 2/1959 | Diels et al. | 86/1 |
| 3,079,832 | 3/1963 | Jacobson | 86/21 |
| 3,552,259 | 1/1971 | Griffith | 86/20.1 X |
| 3,731,584 | 5/1973 | Gilbert | 264/3.2 X |
| 3,811,358 | 5/1974 | Morse | 86/20.12 |
| 4,608,210 | 8/1986 | Müller et al. | 264/3.2 |
| 4,615,270 | 10/1986 | Bell | 102/289 |
| 4,622,000 | 11/1986 | Muller et al. | 264/3.2 X |
| 4,649,823 | 3/1987 | Bell | 102/289 |
| 4,767,577 | 8/1988 | Müller et al. | 264/3.3 |
| 4,776,993 | 10/1988 | Chang et al. | 264/3.3 |
| 5,035,843 | 7/1991 | Schmid | 263/3.2 |

*Primary Examiner*—Peter A. Nelson
*Attorney, Agent, or Firm*—Luther A. Marsh

[57] ABSTRACT

An apparatus for homogenizing plastic explosive material comprises a frame having a base and spaced first and second supports extending perpendicularly therefrom in parallel. First and second spaced parallel generally cylindrical rolls are provided. Each roll is journaled at opposite end portions thereof to the supports. Each roll has an uninterrupted peripheral surface portion for engagement with the plastic explosive material. A crank is operably associated with one of the rolls at a first end thereof for rotating the roll. Gears meshingly interconnect the rolls at a second end thereof so that rotation of the one roll causes associated rotation of the other roll. Plastics explosive material is caused to be drawn between the rolls by their rotation so as to be homogenized.

3 Claims, 1 Drawing Sheet

APPARATUS AND METHOD FOR HOMOGENIZING PLASTIC EXPLOSIVES

FIELD OF THE INVENTION

The disclosed invention is directed to an apparatus and method for quickly and easily transforming a block of compressed plastic explosive material into a soft, homogeneous mass useful for being compacted into a molded explosive charge. More particularly, the invention is to an apparatus and method in which spaced parallel rolls rotate in order to cause plastic explosive material to be drawn therethrough in order to be compressed into an homogeneous mass.

BACKGROUND OF THE INVENTION

Plastic explosives are frequently produced in block shape, which then need to be homogenized prior to being compacted into a molded explosive charge. C-4 explosive, for example, is produced in blocks which are not suitable for fabrication into an M-112 demolition charge. Transformation of the blocks has in the past entailed hand work, which necessarily is time consuming, expensive, and subject to quality inconsistencies.

Hand working of C-4 explosive has involved cutting the blocks into pieces of workable size. The pieces are then mashed and kneaded on a hard surface until a consistency comparable to bread dough is achieved. Because the dexterity of the individual performing this task is important, the resulting product quality is inconsistent, frequently leaving unsatisfactory lumps.

Those skilled in the art recognize that hand labor, such as heretofore been employed for transforming blocks of C-4 explosive into soft, homogeneous masses suitable for compaction into the molded M-112 demolition charge, should be avoided, in the production of a substantially lump-free sheet ready for molding into the desired shape. Speed, elimination of intense labor, and consistency are desired in order to increase the quality and decrease the cost of the resulting charge.

The disclosed invention overcomes the noted disadvantages by providing a hand operated machine for transforming blocks of C-4 explosive material into uniform, substantially lump-free sheets. The machine of the invention employs first and second spaced parallel cooperating rolls between which a block is drawn, with the result that the block becomes transformed relatively quickly and easily into a thin sheet. The disclosed invention permits the transformation to occur in approximately 30 seconds, significantly faster than the ten minutes which had been required by hand working. Not only is speed substantially increased, but the quality and consistency of the resulting product is enhanced.

SUMMARY OF THE INVENTION

An apparatus for homogenizing plastic explosives comprises a frame having a base and spaced first and second supports extending perpendicularly therefrom in parallel. First and second spaced parallel generally cylindrical rolls are provided. Each roll is journaled at opposite ends thereof to the supports. Each roll has an uninterrupted peripheral surface portion for engagement with plastic explosive material. Means are operably associated with one of the rolls at a first end thereof for rotating the roll. Means operably interconnect each of the rolls at a second end thereof, so that rotation of the one roll causes associated rotation of the other roll. Plastic explosive material is drawn between the rolls by operation of the rotating means in order to be compressed therebetween and homogenized into a lump-free sheet.

A method of homogenizing plastic explosive material comprises the steps of providing first and second spaced parallel, smooth surfaced rolls. A block of plastic explosive material is provided. The rolls are rotated while the plastic explosive material is fed therebetween, so that the block is thereby transformed into a smooth surfaced homogenized sheet.

These and other features and advantages of the invention will be readily apparent in view of the following description and drawings of the above-described invention.

BRIEF DESCRIPTION OF THE DRAWINGS

The above and other objects and advantages and novel features of the present invention will become apparent from the following detailed description of the preferred embodiment of the invention illustrated in the accompanying drawings, wherein.

DETAILED DESCRIPTION OF THE INVENTION

Figures 1, 2, 3, 4, 5:
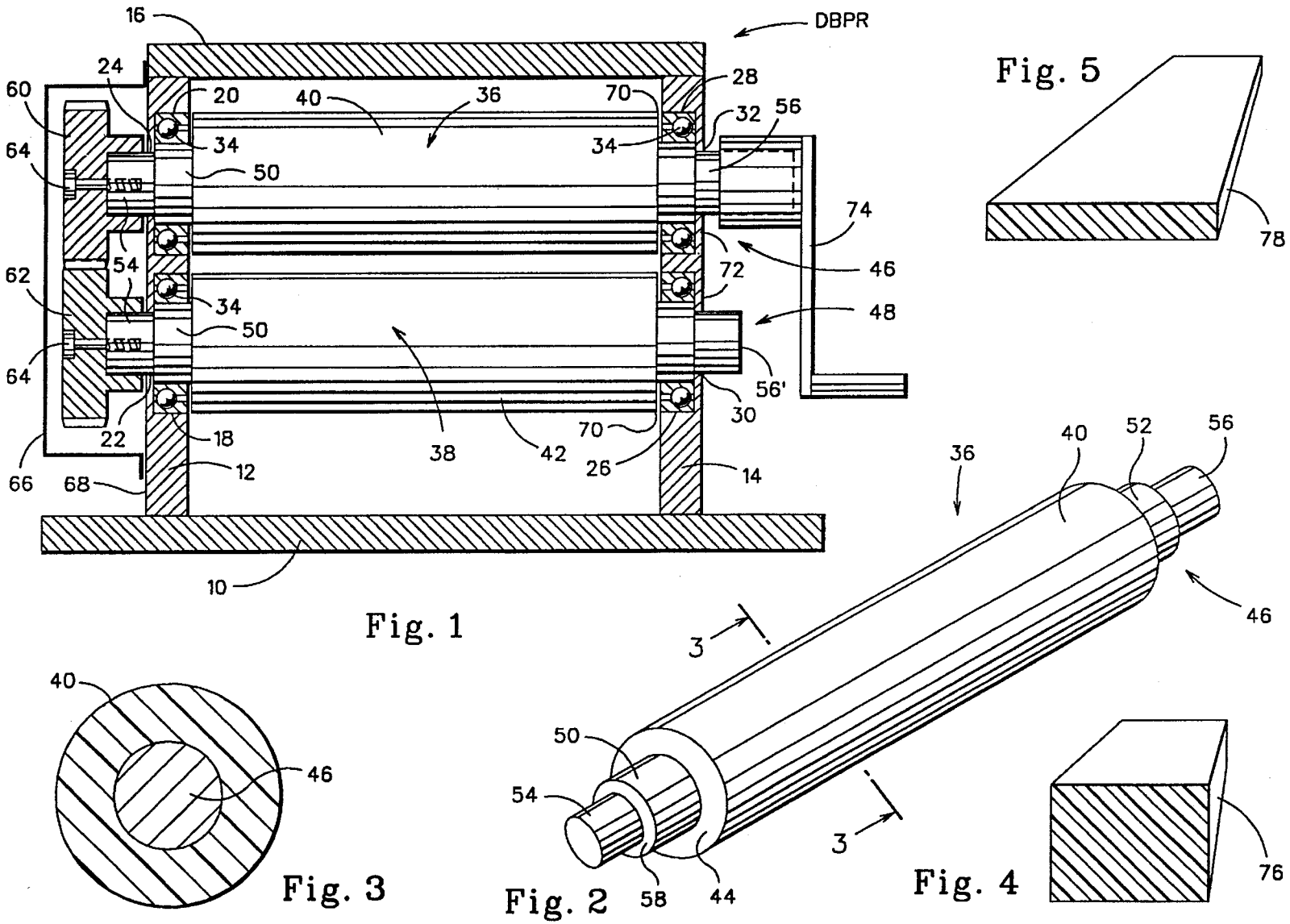
FIG. 1 is an elevational view partially in section of the machine of the invention.
FIG. 2 is a perspective view of one of the rolls of the machine of FIG. 1.
FIG. 3 is a cross sectional view taken along the line 3—3 of FIG. 2.
FIG. 4 is a perspective view partially in section of a block of plastic explosive material.
FIG. 5 is a perspective view partially in section of a sheet of plastic explosive material homogenized by the machine of FIG. 1.

Demolition block plasticizer roller DBPR, as best shown in FIG. 1, has a frame which includes base 10 from which spaced parallel supports 12 and 14 extend vertically. Top support 16 extends between the upper ends of supports 12 and 14 for maintaining them in the defined orientation. Base 10 is adapted to be supported by a table, work bench, or the like. The base 10 preferably extends laterally beyond the supports 12 and 14 in order to permit a C-clamp to be used at the opposite ends for securing the base 10, and hence the DBPR, to that horizontal support. I prefer that the base 10, the supports 12 and 14, and the top support 16 be fabricated from aluminum or similar material in order to eliminate the potential for sparking in view of the environment in which the DBPR is to be used.

Support 12 has first and second bores 18 and 20 formed therein in spaced vertical orientation. Each bore has a central aperture 22 and 24, respectively, therethrough. The apertures 22 and 24 are coaxial with the bores 18 and 20, respectively. Corresponding bores 26 and 28 are formed in support 14 in coaxial alignment with the bores 18 and 20, respectively. Apertures 30 and 32 are formed therein and are coaxial with apertures 22 and 24, respectively. The apertures 22 and 24 have a diameter less than the diameter of their bores 18 and 20, thus providing a flange for the respective bore. The apertures 30 and 32 have a diameter less than the diameter of their apertures 26 and 28 for also providing a flange partially closing off the bore. Sealed roller bearings 34 are positioned within each of the bores 18, 20 and 26, 28 and rest against the adjacent flange. The roller bearings preferably are sealed roller bearings available from McMaster-Carr Supply Company, under part number 6384K63.

Rolls 36 and 38 are journaled within the respective aligned bores 20 and 28 and 18 and 26, as best shown in FIG. 1, and extend in parallel. The rolls 36 and 38 are preferably of a two-part construction. The rolls 36 and 38 are essentially identical in their construction, and the roll 36 is illustrated in FIG. 2.

Each of rolls 36 and 38 has an outer, smooth, uninterrupted surface portion 40 and 42, respectively, which presses against the plastic explosive material. The surfaces 40 and 42 are each preferably formed from polytetrafluroethylene (PTFE). PTFE is preferred because it is a masking, insulating, and lubricating material which resists sticking by the explosive material and it may be easily cleaned. PTFE may be purchased from E.I. DuPont De Nemours Company under the name Teflon®. The PTFE is in cylindrical form and has a length of four inches, with the rolls each having a diameter of 1.430 inches. The ends of each of the rolls 36 and 38 terminate in shoulders 44 and 70, as best shown in FIGS. 1 and 2. The shoulders 44 and 70 of the rolls 36 and 38 have sufficient free space with the associated bearings 34 to prevent explosive material from becoming impacted between the supports 12 and 14 and the ends of the rolls.

Cores 46 and 48 extend through the rolls 36 and 38, respectively, as best shown in FIG. 1, and preferably are formed from tempered brass or beryllium copper. Projections 50 and 52 are provided at the ends of each core, with the core 46 being shown in FIG. 2. The projections are integral with the core and formed of the same material. Hubs 54 and 56 extend from projections 50 and 52, respectively, and likewise are integral therewith. The projections have a diameter of about 0.625 inches, while the hubs have a diameter of about 0.5 inches. The hubs 54 and 56 are coaxial with the projections 50 and 52 which likewise are coaxial with the roll 36. The roll 38 has a similar core arrangement, with projections and hubs. The hub 56 of roll 36 preferably extends further from the projection 52 than the hub 54 extends from the projection 50. The hubs and projections of the roll 38, on the other hand, extend a uniform distance corresponding from the distance the hub 54 and projection 50 extend from shoulder 44. Hub 56 of roll 36 extends further than does hub 56' of roll 38, as best shown in FIG. 1.

The projections 50 are each received within the aperture of a respective bearing 34 of the bores 18 and 20, as best shown in FIG. 1. The projections 50 each have a shoulder 58, as best shown in FIG. 2, which seats against the flange through which the apertures 22 and 24 extend. The hub 54 of each of rollers 36 and 38 extends through the apertures 22 and 24, respectively. Gears 60 and 62 are secured to the hubs 54, such as by bolts 64, as best shown in FIG. 1. The gears 60 and 62 are meshingly engaged, so that rotation of one causes corresponding rotation of the other. The gears 60 and 62, and the bolts 64, as are all materials of the DBPR, are formed from spark-proof materials. A housing 66 extends about the gears 60 and 62 and causes them to be enclosed relative to the exterior of sidewall 68 of support 12. The housing 66 preferably is inwardly spaced relative to the end of base 10 in order to provide sufficient space for the C-clamp attachment.

Projections 52 of rolls 36 and 38 likewise are received within the apertures of the bearings 34 of the bores 26 and 28 of support 14. Shoulders 70 have sufficient free space with the bearings 34 in order to prevent the explosives from becoming impacted between the bearings 34 and rolls 36 and 38. As with the opposite ends, a flange 72 is at the end of the bores 26 and 28. The hubs 56 and 56' extend through the apertures 30 and 32. Crank 74 is secured to hub 56 of upper roll 36.

The projections and hubs at the opposite ends of the rolls 36 and 38 journal the rolls in the respective roller bearings 34. The roll 36 is rotated on its axis by manual operation of the crank 74, with the result that corresponding rotation occurs at roll 38 because of the intermeshed gears 60 and 62. I prefer that the surfaces 40 and 42 of the rolls 36 and 38 be spaced apart a distance of about 0.070 inches, which is sufficient to eliminate all lumps when C-4 explosive is processed with the DBPR.

Operation of the DBPR of FIG. 1 to transform compressed plastic explosive material into a soft homogeneous mass useful in preparing compacted molded explosive charges may be easily accomplished by manual operation of the crank 74. A block of explosives, such as the block 76 of FIG. 4, is first cut in workable size. Block 76 is brought adjacent rolls 36 and 38, and the crank is operated in order to cause rotation of the roll 36 and hence of the roll 38. As the crank 74 is turned, the block 76 is fed between the rolls 36 and 38 and transformed into a soft homogeneous sheet 78, as best shown in FIG. 5. Because of the 0.070 inch clearance between the smooth pressing surfaces 40 and 42, then lumps are eliminated from the explosive material. The sheet 78 may then be processed into a shaped charge.

While this invention has been described as having a preferred design, it is understood that it is capable of further modifications, uses, and/or adaptations of the invention, which follow in general the principle of the invention and includes such departures from the present disclosure as come within known or customary practice in the art to which the invention pertains, and that may be applied to the central features hereinbefore set forth, and fall within the scope of the limits of the appended claims.

What I claimed is;

1. An apparatus for homogenizing plastic explosives, comprising:

a) a frame comprising a base and spaced first and second parallel supports extending perpendicularly therefrom;

b) first and second spaced parallel generally cylindrical rolls, each roll journaled at opposite end portions thereof to said supports and each roll having an uninterrupted peripheral surface portion for engagement with plastic explosive material;

c) means operably associated with one of said rolls at a first end thereof for rotating said one roll; and d) means operably interconnecting said rolls at a second end thereof so that rotation of said one roll causes associated rotation of the other roll and plastic explosives thereby caused to be drawn between said rolls so as to be homogenized;

e) said peripheral surface of a core each roll has a non-stick surface of PTFE; and f) said core of each roll is formed from a material consisting essentially of tempered brass and beryllium copper.

2. The apparatus of claim 1, wherein:

a) said rolls are spaced to provide a gap of about 0.070 inches therebetween through which the plastic explosive material passes.

3. The apparatus of claim 1, wherein:

a) said rotating means is a crank;

b) said interconnecting means includes first and second meshingly engaged gears, each gear mounted to the second end of said rolls;

c) each of said gears is disposed exterior of the associated support;

d) each of said supports has first and second bores therein, and each bore has an aperture therethrough;

e) each roll has a first portion journaled within said bores and a second portion extending through the associated aperture;

f) each of said gears is mounted to one of said second portions;

g) a bearing assembly is positioned within each of said bores and is operably associated with the associated first portion of each roll;

h) each bearing assembly is a sealed roller bearing;

i) said crank is secured to the second portion of said one roll;

j) said base extends laterally beyond said support for providing a securement area for said frame;

k) a cover is secured to one of said supports and surrounds said gears, said cover has an endwall disposed inwardly relative to said base;

l) a top support is secured to an extends between said supports;

m) said rolls are spaced to provide a gap of about 0.070 inches therebetween through which the plastic explosive material passes; and n) each roll second end portion has first and second cylindrical coaxial elements, said first element has a diameter exceeding the diameter of said second element, and each first element is received within said bore and each second element extends through the associated aperture.

* * * * *